US005400454A

United States Patent [19]

Cunningham

[11] Patent Number: 5,400,454

[45] Date of Patent: Mar. 28, 1995

[54] METHOD FOR SUPPORTING A TRANSPORTATION SURFACE

[76] Inventor: John Cunningham, 35 Loughberry Rd., Saratoga Springs, N.Y. 12866

[21] Appl. No.: 36,466

[22] Filed: Mar. 24, 1993

[51] Int. Cl.[6] ..... E01D 19/02; E02D 27/34

[52] U.S. Cl. ..... 14/77.1; 14/18; 14/73; 14/75; 52/167.7; 52/167.4

[58] Field of Search ..... 14/20, 21, 22, 73, 73.5, 14/75, 77.1, 77.3, 78; 248/560, 602, 679; 52/167 E, 167 RM

[56] References Cited

U.S. PATENT DOCUMENTS

| | | | |
|---|---|---|---|
| 3,500,625 | 3/1970 | Gokyu | 14/22 |
| 3,659,633 | 5/1972 | Durkee et al. | 14/22 |
| 3,977,140 | 8/1976 | Matsudaira et al. | 52/167 RM |
| 4,332,118 | 6/1982 | Westberg | 14/73.5 X |
| 4,946,128 | 8/1990 | Cunningham | 248/560 |
| 5,205,528 | 4/1993 | Cunningham | 248/602 |

FOREIGN PATENT DOCUMENTS

| | | | |
|---|---|---|---|
| 171226 | 5/1960 | Sweden | 14/20 |

*Primary Examiner*—Ramon S. Britts
*Assistant Examiner*—James A. Lisehora
*Attorney, Agent, or Firm*—Porter, Wright, Morris & Arthur

[57] ABSTRACT

A method of supporting a transportation surface, such as a vehicular bridge, a railroad trestle or an elevated walkway, that is resistant to unexpected, infrequent shocks such as might be encountered during an earthquake or similar disaster. The method includes arranging laterally spaced apart fixed bearing members on a surface adjacent a path for a transportation surface and supporting elongated elastic members on the bearing members at a distance spaced inwardly from the ends of the elastic members. The transportation surface may be placed in association with the elastic members. Beginning from an equilibrium state, each elastic member is capable of bending in proportion to the magnitude of an additional load applied intermediate the ends of the elastic member, with the ends of the elastic member sliding against the bearing members a distance also proportional to the magnitude of the additional load.

1 Claim, 3 Drawing Sheets

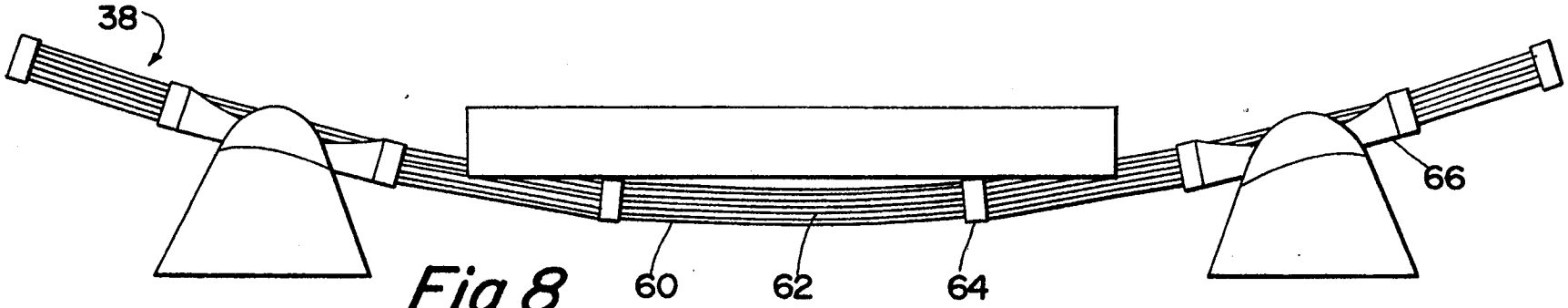
Fig. 8
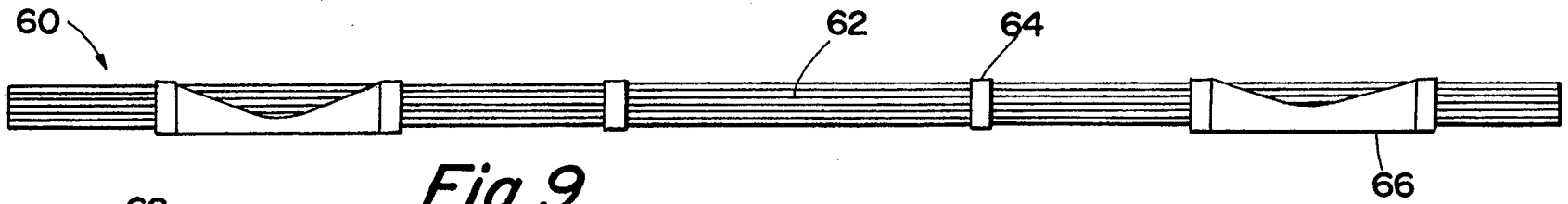
Fig. 9
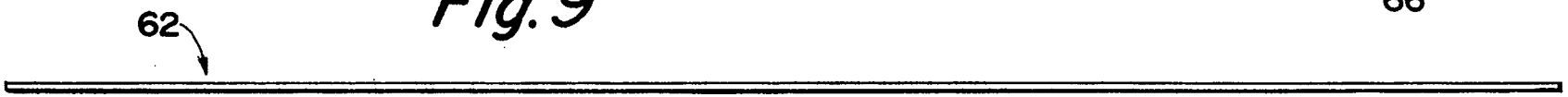
Fig. 10
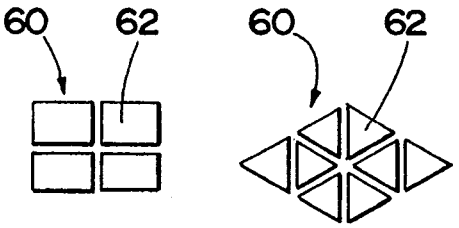
Fig. 12a
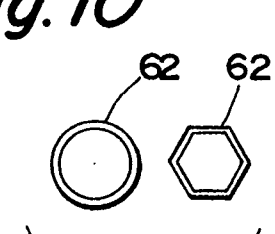
Fig. 12b
Fig. 12c
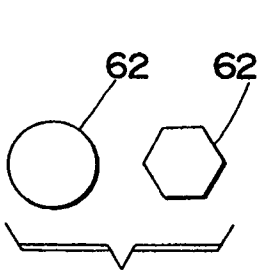
Fig. 12d
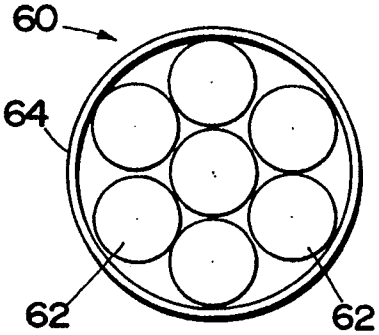
Fig. 11

METHOD FOR SUPPORTING A TRANSPORTATION SURFACE

BACKGROUND AND SUMMARY OF THE INVENTION

The present invention relates to a method for supporting a transportation surface, such as a vehicular bridge, a railroad trestle or an elevated walkway. More particularly, the present invention relates to a homeostatic method for supporting a transportation surface such that the supporting structure is resistant to unexpected, infrequent shocks such as might be encountered during an earthquake or similar disaster.

Conventional methods for supporting transportation surfaces frequently result in essentially rigid structures, i.e., the structures do not yield appreciably on the application of an external force. When an external force is applied to such a rigid supporting structure, a variety of tensile, compressive and bending forces may be created within the structure. If the external force is sufficiently high, the supporting structure may fail, resulting in damage to the transportation surface and the risk of harm to persons and vehicles on the transportation surface, as well as to persons and objects below the transportation surface. To reduce the risk of such occurrences, existing methods for supporting transportation surfaces frequently call for overdesign of at least some portions of these rigid supporting structures.

Methods for supporting rigid structures may include the use of devices, such as rubber bearings containing a core of lead to absorb heat, to provide some degree of seismic isolation to these structures. These isolating devices have several known disadvantages. The devices depend on the interaction of specialized materials, some of which tend to deteriorate over time, resulting in a decrease in the protective capacity or the expenses associated with periodic replacement. Known bearings also are unlikely to be capable of responding to the magnitude of the displacement associated with a severe seismic event. Bearings that lack sufficient shock-absorbing capability may exaggerate rather than minimize the effects of seismic shock.

Other known methods for supporting transportation surfaces result in flexible structures, such as conventional suspension bridges, that are capable of yielding to an external force. However, because these structures generally lack means for effectively dissipating energy, they tend to store the energy associated with application of an external force in a spring-like manner, resulting in undesirable oscillation of the supporting structure. Oscillation of structures supporting transportation surfaces may disrupt use of transportation surfaces, for example, during high wind conditions. Under more extreme conditions, oscillation of the supporting structure may result in damage to the transportation surface and the risk of harm to persons and property, as described above.

The method of the present invention uses simple construction techniques and materials, requires no special maintenance, and is capable of reacting to displacements of a large magnitude. The present invention provides a method for supporting a transportation surface on a structure whose elements are in or tending toward a relatively stable state of equilibrium. "Homeostasis" is defined as "a relatively stable state of equilibrium or a tendency toward such a state between the different but interdependent elements or groups of elements of an organism or group" (Webster's New Collegiate Dictionary, G. & C. Merriam Co., 1976). Hence the method of the present invention may be referred to as a homeostatic method.

The present invention provides a method for supporting a transportation surface that includes arranging laterally spaced apart fixed bearing members on a surface adjacent a path for a transportation surface and supporting elongated elastic members on a bearing surface of the bearing members at a distance spaced inwardly from the ends of the elastic members. Each elastic member is capable of bending in proportion to the magnitude of a load applied intermediate the ends of the elastic members. A transportation surface may be placed in association with the elastic members, each of which supports only the share of the transportation member which is acting directly above it. The method of the present invention establishes an equilibrium state between the bending elastic members and the weight of the transportation surface.

Beginning from such an equilibrium state, an additional load applied intermediate the ends of the elastic members causes the midportion of each elastic member to bend from a first equilibrium position an amount proportional to the magnitude of the additional load and assume a second, more downwardly bowed position. The ends of the elastic members slide against the bearing members a distance also proportional to the magnitude of the additional load as the midportion bows downwardly. The movement of the elastic members establishes a new equilibrium state between the bending elastic members and the weight of the transportation surface. When the additional load is removed, the midportions unbow, returning to substantially the same positions as their original equilibrium positions. The ends of the elastic members slide a corresponding distance in the opposite direction, also returning to substantially the same positions are their original equilibrium positions. The midportions of the elastic members bend and the ends of the elastic members slide in a similar manner in response to a force applied upwardly against the bottom of the elastic members or a force applied against any of the bearing supports.

The bending and sliding of the elastic members in response to changes in the load supported by the structure may perform shock and energy absorbing functions when the elastic members engage the bearing surface. The absorbed energy is dissipated primarily in the form of heat generated by the frictional contact between the elastic members and the bearing surfaces. Preferably, the elastic members engage the bearing surface during bending from an external force at a homeostatic, or critical, angle, i.e., an angle within the range of about 25 to about 50 degrees from a vertical axis of support for the structure.

BRIEF DESCRIPTION OF THE DRAWINGS

FIG. 8 is a side elevational view of a support for a transportation surface in accordance with another embodiment of the method of the present invention;

FIG. 9 is a detail view of the composite elastic member of the method of FIG. 8;

FIG. 10 is a detail view of a single element of the composite elastic member of FIG. 9;

FIG. 11 is a sectional view of a plurality of the single elements of FIG. 10 bound as one larger composite elastic member;

FIGS. 12*a*–12*d* are sectional views of different embodiments of individual elastic members and composite shapes for a collection of elastic members.

DESCRIPTION OF PREFERRED EMBODIMENT(S)

Figure 1:
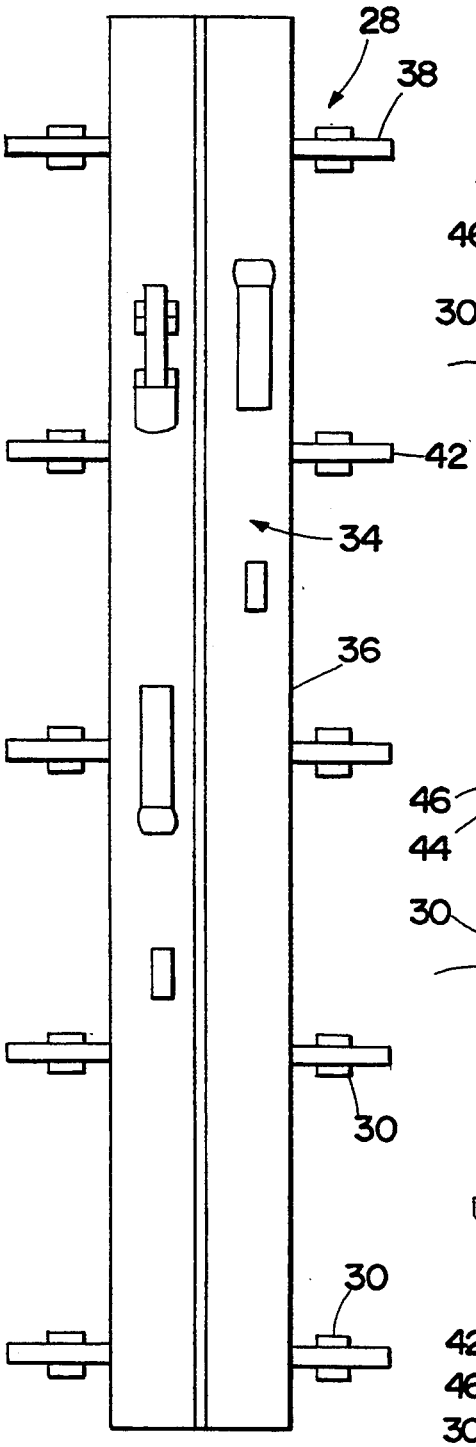
FIG. 1 is a top plan view of a support for a transportation surface in accordance with an embodiment of the method of the present invention.
Figure 2:
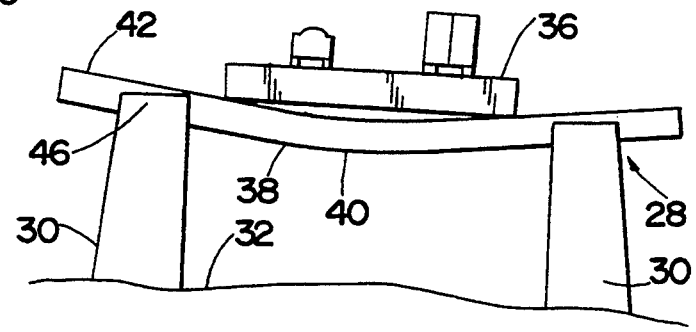
FIG. 2 is a sectional view of a support for a transportation surface in accordance with the method of FIG. 1, showing the transportation surface and its supporting structure in an original equilibrium position.

Referring now to the drawings, FIG. 1 shows a structure 28 having laterally spaced apart fixed bearing supports 30 arranged on the ground or other surface 32 adjacent a path 34 for a transportation surface 36. Each pair of bearing supports 30 may be located a predetermined distance along the path 34 from another pair of bearing supports 30. As shown in FIG. 2, an elastic support member 38 may be arranged substantially perpendicular to the path 34 with a midportion 40 extending between a pair of bearing supports 30 and end portions 42 extending longitudinally beyond the pair of bearing supports 30.

Figure 3:
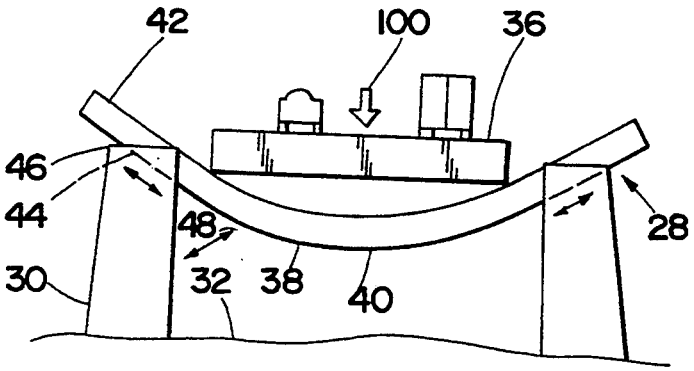
FIG. 3 is a sectional view of a support for a transportation surface in accordance with the method of FIG. 1, showing the bending of elastic members of the supporting structure in response to an applied force.

Each bearing support 30 may have disposed therein, preferably in a top portion 46, a bearing surface 44, as shown in FIG. 3. The bearing surface 44 may engage an elastic member 38 at a distance spaced inwardly from one of its ends 42. Although the drawings show only one bearing surface 44 for each bearing support 30, more than one bearing surface 44 may be provided on a single bearing support 30. The bearing surface 44 may be angled downwardly toward the center of the structure as shown by the dotted line in FIG. 3. Suitable safety guard members providing means to inhibit upward movement of the elastic members 38 normal to the bearing supports 30 may be installed on the bearing supports 30 to prevent the elastic members 38 from disengaging the bearing surfaces 44 on the bearing supports 30.

The elastic member 38 preferably engages bearing surface 44 at a critical angle 48, i.e., an angle within the range of about 25 to about 50 degrees from a vertical axis of support for the structure. The critical angle 48 permits the supporting structure 28 optimally to absorb shock and energy, as described below. Angles outside of this range also may work and are included within the scope of this invention.

Each of the elastic members 38 is capable of bending in proportion to the magnitude of a load applied to a midportion 40 of the elastic members intermediate the ends 42. When a transportation surface 36 is overlaid on the midportions 40 of two or more elastic members 38, each of the elastic members 38 supports only the share of the transportation surface 36 which is acting directly above it. The method of the present invention establishes an equilibrium state between the bending elastic members 40 and the weight of the transportation surface 36, as shown in FIG. 2.

Beginning from an equilibrium state, an additional load 100 applied intermediate the ends 42 of the elastic members 38 causes the midportion 40 of each elastic member 38 to bend from a first equilibrium position an amount proportional to the magnitude of the additional load 100 and assume a second, more downwardly bowed position as shown in FIG. 3. The ends 42 of each of the elastic members 38 slide against the bearing surfaces 44 a distance also proportional to the magnitude of the additional load 100 as the midportion 40 bows downwardly. The movement of the elastic members 38 establishes a new equilibrium state between the bending elastic members 38 and the total applied load consisting of the weight of the transportation surface 36 and the additional load 100. When the additional load 100 is removed, the midportions 40 unbow, returning to substantially the same positions as their original and slightly bowed equilibrium positions. The ends 42 of the elastic members 38 slide a corresponding distance in the opposite direction, also returning to substantially the same positions as their original equilibrium positions.

In a similar manner, the midportions 40 of the elastic members 38 bow upwardly and the ends 42 slide relative to the bearing surface 44 in response to a force applied upwardly against the bottom of the elastic members 38. Each of the ends 42 is capable of unique and distinct movement on its respective bearing surface 44 with respect to any of the other ends 42, in response to bending of the midportions 40 or external forces applied to any of the bearing supports 30.

If an applied force does not result in displacement of any of the bearing supports 30, the transportation surface 36 and its supporting structure 28 will return substantially to their original equilibrium positions with a minimum of oscillation. If any of the bearing supports 30 is deformed or lost, the transportation surface 36 and its supporting structure 28 will reach a new equilibrium state, in which the displacement of the transportation surface 36 from its original position is proportional to the product of the number of elastic member ends 42 displaced and the total displacement of those ends 42, and inversely proportional to the number of elastic member ends 42 that remain supported by bearing supports 30. Stated another way, the total displacement of the transportation surface 36 from its original position generally will be some fraction of the total displacement of the ends 42, with the fractional numerator representing the number of ends 42 displaced and the fractional denominator representing the total number of support ends 42 in the system.

Figure 4:
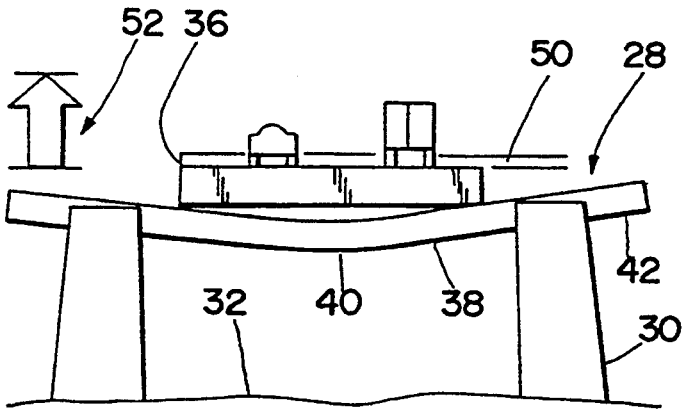
FIG. 4 is a sectional view of a support for a transportation surface in accordance with the method of FIG. 1, showing the horizontal displacement of the transportation surface resulting from a horizontal displacement of a bearing member.
Figure 6:
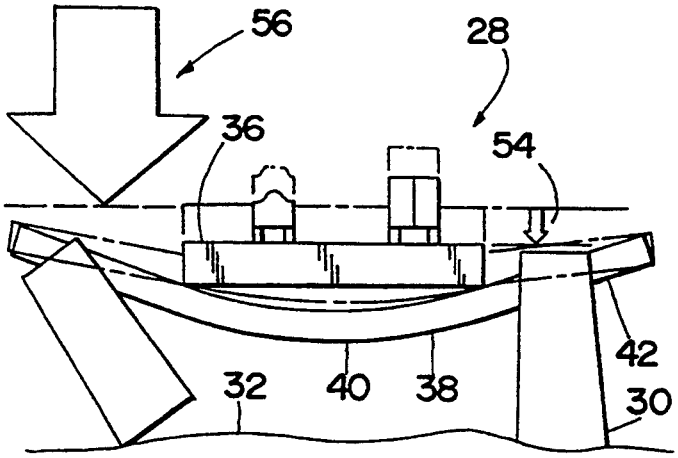
FIG. 6 is a sectional view of a support for a transportation surface in accordance with the method of FIG. 1, showing the horizontal displacement of the transportation surface resulting from a large displacement of one or more bearing members.
Figure 5:
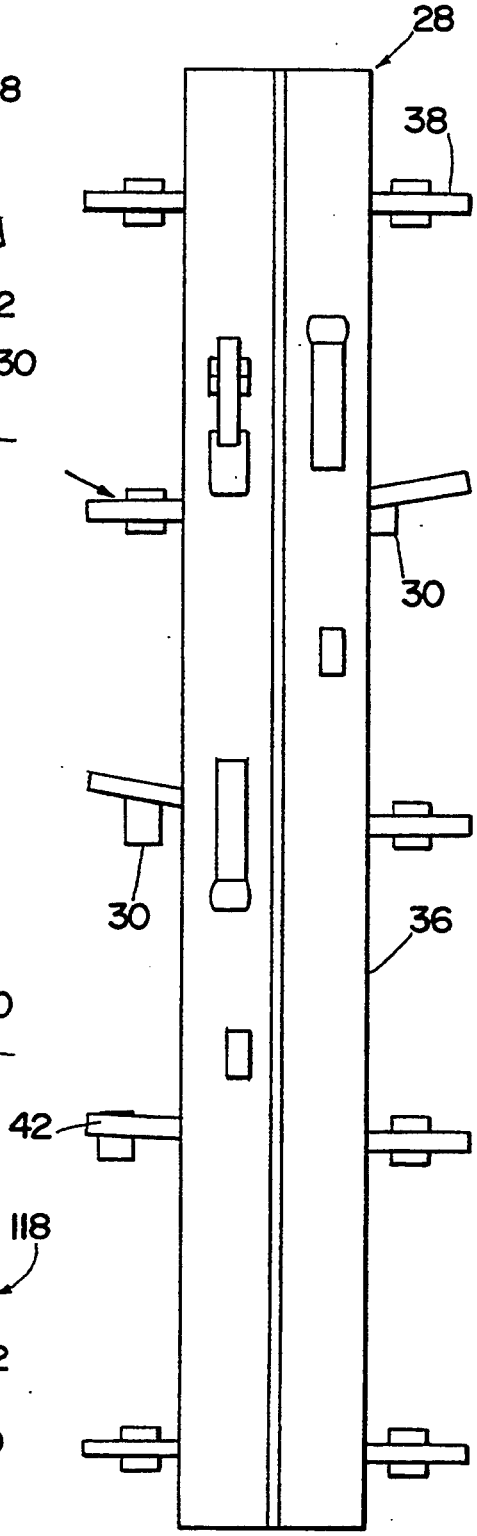
FIG. 5 is a top plan view of a support for a transportation surface in accordance with the method of FIG. 1, showing displacement of various components of the supporting structure.

As shown in FIG. 4, if one of the bearing supports 30 of the structure 28 shown in FIG. 1 is displaced upwardly against the bottom of an elastic member 38, the upward displacement 50 of the transportation surface 36 is less than the upward displacement 52 of the affected bearing support 30. Similarly, if some, but not all, of the bearing supports 30 are displaced as shown in FIG. 5, the downward displacement 54 of the transportation surface 36 is less than the downward displacement 56 of the affected bearing supports 30, as shown in FIG. 6.

Figure 7:
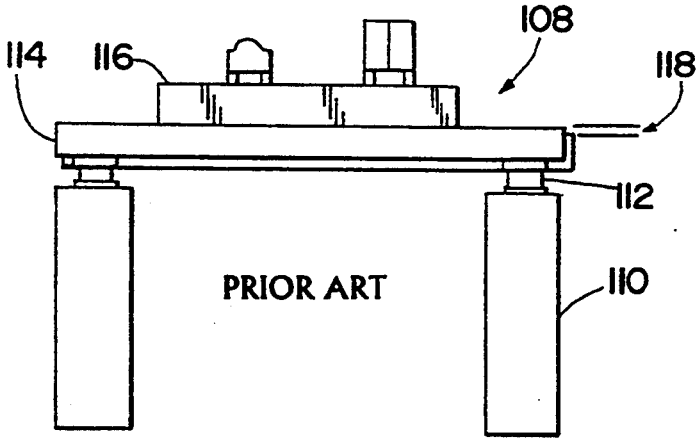
FIG. 7 is a sectional view of a conventional support for a transportation surface having lead-rubber seismic isolators interposed between the supports and the transportation surface, showing the extent of the horizontal displacement available in such a system.

FIG. 7 shows a supporting structure 108 constructed using conventional seismic isolation methods. The conventional structure 58 includes a pair of laterally spaced apart fixed supports 110. Lead-rubber isolators 112 on each support 110 engage a rigid beam 114 which supports a transportation surface 116. The conventional method results in a supporting structure 108 having only a limited amount of movement 118 in response to a shock, as shown by the dotted lines of FIG. 7. By contrast, the method of the present invention results in a supporting structure 28 that can move to a considerably greater degree in response to a shock, while generally limiting movement of the transportation surface 36 to a fraction of the movement of the supporting structure 28.

An elastic member 38 of the present invention may be a unitary member as shown in FIGS. 1–6, or a composite flexible member 60 as shown in FIG. 8. The composite member 60, as shown in FIG. 9, may be a bundle of elastic member subunits 62, shown in FIG. 10, held together by a restraining band 64, or a plurality of restraining bands 64 disposed at predetermined distances along the bundle 60. In FIG. 11, the composite member 60 is shown in cross-section, revealing the subunits 62 and the band 64. An elastic subunit 62 may be of hollow or solid cross-section of any appropriate shape as shown in FIGS. 12*a–d*. The cross-section of a composite member 60 also may be of any appropriate shape as shown in FIGS. 11 and 12*a–b*.

Figure 13:
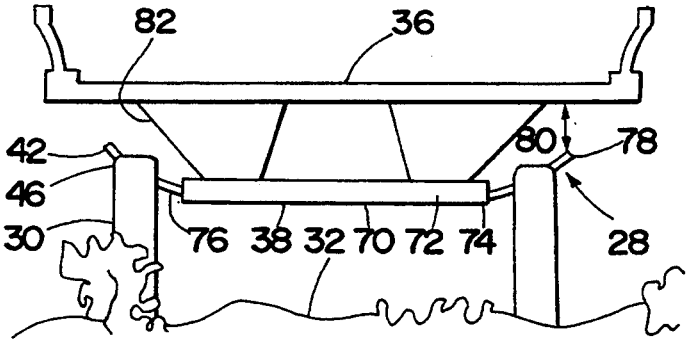
FIG. 13 is a sectional view of a support for a transportation surface in accordance with another embodiment of the method of the present invention.

The elastic member 38 also may be a combination member 70 as shown in FIG. 13. The combination member 70 may have a rigid central platform 72 on which the transportation surface 36 may be supported. The platform 72 has opposite end portions 74 with at least one flexible member 76 attached to each of the end portions 74.

Also as shown in FIG. 13, the transportation surface 36 may overhang the supporting structure 28. In such an embodiment, the transportation surface 36 must be elevated above the outer ends 78 of the flexible members 76 to provide adequate clearance 80 for the bending of the flexible members 76. This may be accomplished by interposing spacer means 82 between the transportation surface 36 and the platform 72.

The above-described preferred embodiments should not be construed as limiting and are susceptible to modification by one skilled in the art. Such modification is considered to be within the spirit of the present invention and under the protection of the following claims. This invention is a pioneer invention deserving of a broad scope of coverage.

What is claimed is:

1. A method for supporting a transportation surface, said method comprising the steps of:

arranging a pair of laterally spaced apart fixed bearing supports on a surface adjacent a path for a transportation surface;

forming each of said pair of bearing supports with a bearing surface for engaging an elongated elastic member;

selecting an elongated elastic support member capable of bending from an equilibrium position to assume a more downwardly bowed position when said elastic member is supported at a distance spaced inwardly from each of its ends and a load is applied to a midportion of said elastic member intermediate said ends;

arranging said elastic member substantially perpendicular to the path with said midportion of said elastic member extending between said pair of bearing supports and said end portions of said elastic member extending longitudinally beyond said pair of bearing supports;

arranging a second pair of laterally spaced apart fixed bearing supports on the surface adjacent the path at a predetermined distance from said first pair of bearing supports;

forming each of said second pair of bearing supports with a bearing surface for engaging a second elongated elastic member;

selecting a second elongated elastic support member capable of bending from an equilibrium position to assume a more downwardly bowed position when said second elastic member is supported at a distance spaced inwardly from each of its ends and a load is applied to a midportion of said second elastic member intermediate said ends, at least one of said elastic members comprising a composite member including a rigid central platform for supporting a transportation surface, said platform having opposite sides with at least one flexible member attached to each side;

arranging said second elastic member substantially perpendicular to the path with said midportion of said second elastic member extending between said second pair of bearing supports and said end portions of said second elastic member extending longitudinally beyond said second pair of bearing supports;

placing said first and second elastic members in engagement with bearing surfaces on their respective bearing supports to enable said end portions of said first and second elastic members to slidably move relative to their respective bearing supports in response to a bending of said midportions of said first and second elastic members or in response to external forces applied to any of said bearing supports; and supporting a transportation surface on said first and second elastic members:

providing a spacer between said transportation surface and said rigid central platform, said transportation surface having edges and being sized such that the transportation surface extends outwardly beyond the sides of the platform, said spacer providing clearance between said edges of the transportation surface and the at least one flexible member attached to each of the platform sides.

* * * * *